US009770086B2

(12) United States Patent
Prisco et al.

(10) Patent No.: US 9,770,086 B2
(45) Date of Patent: Sep. 26, 2017

(54) SYSTEM FOR TRANSPORTING RECREATIONAL AND SPECIALIZED FOOTWEAR

(71) Applicants: Geoffrey Prisco, Brooklyn, NY (US); Alex Baril, Brooklyn, NY (US)

(72) Inventors: Geoffrey Prisco, Brooklyn, NY (US); Alex Baril, Brooklyn, NY (US)

( * ) Notice: Subject to any disclaimer, the term of this patent is extended or adjusted under 35 U.S.C. 154(b) by 0 days.

(21) Appl. No.: 14/976,137

(22) Filed: Dec. 21, 2015

(65) Prior Publication Data

US 2017/0172287 A1 Jun. 22, 2017

(51) Int. Cl.

| | |
|---|---|
| ***A45F 3/14*** | (2006.01) |
| ***A45F 3/04*** | (2006.01) |
| *A43B 5/04* | (2006.01) |

(52) U.S. Cl.

CPC ..... *A45F 3/14* (2013.01); *A45F 3/04* (2013.01); *A43B 5/0425* (2013.01); *A45F 2003/142* (2013.01)

(58) Field of Classification Search

CPC ..... A45F 2003/142; A43B 5/0425
USPC ..... D3/317
See application file for complete search history.

(56) References Cited

U.S. PATENT DOCUMENTS 2,672,263 A * 3/1954 Alber ..... A45F 5/00 206/315.1
2,679,937 A * 6/1954 Fulster ..... A47L 23/20 211/34
3,537,594 A * 11/1970 Daley ..... A43B 5/0425 211/37
3,587,951 A * 6/1971 Derouin ..... A43B 5/0425 211/34
3,590,410 A * 7/1971 Shields ..... A43B 5/0425 12/120.5
3,600,734 A * 8/1971 Pollinger ..... A43B 5/0425 12/120.5
3,653,565 A * 4/1972 McAusland ..... A63C 11/023 224/250
3,775,794 A * 12/1973 Fisher ..... A43B 5/0425 12/1 R
4,244,498 A * 1/1981 Copp ..... A43B 5/0425 294/162
4,251,016 A * 2/1981 O'Rafferty ..... G10G 5/005 224/250
4,529,240 A * 7/1985 Engel ..... A22B 5/161 24/129 R
4,537,436 A * 8/1985 Pfortmiller ..... A63C 11/023 294/148
4,629,103 A * 12/1986 Miller ..... A43B 5/0425 224/250
4,696,504 A * 9/1987 Roberts, Jr. ..... A43B 5/0425 294/148

(Continued)

*Primary Examiner* — Justin Larson
(74) *Attorney, Agent, or Firm* — Kristin A. Grant

(57) ABSTRACT

The present invention presents a system for transporting a pair of recreational or specialized footwear comprising a handle, a left body for holding a left shoe, a right body for holding a right shoe, a left pivot point in between the left body and the left side of the handle allowing the left body to be rotated 360 degrees, a right pivot point in between the right body and the right side of the handle allowing the right body to be rotated 360 degrees and a connector comprising of two or more corresponding parts for securing the left body to the right body.

8 Claims, 9 Drawing Sheets

(56) References Cited

U.S. PATENT DOCUMENTS 4,761,029 A * 8/1988 Woodcock ..... A63C 11/023 294/148
4,790,462 A * 12/1988 Kawaguchi ..... A43B 5/0425 224/250
4,815,642 A * 3/1989 Ray ..... A45F 3/14 12/120.5
4,867,359 A * 9/1989 Donovan ..... A43B 5/0425 224/250
4,911,347 A * 3/1990 Wilhite ..... A45F 3/14 224/251
D335,576 S * 5/1993 Phillpott ..... D3/317
5,285,939 A * 2/1994 Hogan ..... A43B 5/0425 224/250
5,350,096 A * 9/1994 Sieber ..... A45F 3/14 224/153
5,513,787 A * 5/1996 Reed ..... A45C 3/12 224/602
5,642,842 A * 7/1997 Taras ..... A45F 5/00 224/250
5,690,261 A * 11/1997 Moore ..... A45F 3/14 206/278
5,695,101 A * 12/1997 Frietze ..... A45F 3/14 224/250
5,785,220 A * 7/1998 Leddy ..... A63C 11/023 224/250
5,785,223 A * 7/1998 Matsushita ..... A63C 11/023 224/257
5,788,305 A * 8/1998 Hung ..... A43B 5/0425 294/141
5,853,213 A * 12/1998 Simpson ..... A45F 5/10 294/158
5,882,056 A * 3/1999 Broadwell ..... A42B 3/006 224/255
5,908,206 A * 6/1999 LoPresti, Jr. ..... A45F 3/14 2/160
5,997,065 A * 12/1999 Norris ..... A45F 3/14 294/149
6,000,591 A * 12/1999 Alexander ..... A45F 3/14 211/113
6,182,382 B1 * 2/2001 Skinner ..... A43B 5/0425 12/128 R
6,182,875 B1 * 2/2001 Fareghi ..... A45F 3/14 224/258
6,247,739 B1 * 6/2001 Lyon ..... A45F 5/1026 294/137
6,446,849 B1 * 9/2002 Schleifer ..... A43B 5/0425 224/258
6,454,335 B1 * 9/2002 Wishnick ..... A63C 11/023 280/816
D578,763 S * 10/2008 Walker ..... D3/231
7,470,842 B2 * 12/2008 Miller ..... G10G 5/005 84/329
7,735,244 B1 * 6/2010 Ameche ..... A43B 1/10 36/102
D687,635 S * 8/2013 Choi ..... D3/317
8,662,318 B1 * 3/2014 Caporale-Colon ..... A45F 5/00 211/34
8,714,370 B2 * 5/2014 Jebara ..... A45F 5/06 211/34
2005/0194803 A1 * 9/2005 Perry ..... A45F 3/14 294/145
2007/0272570 A1 * 11/2007 Brooks ..... A43B 5/0425 206/315.9
2008/0011567 A1 * 1/2008 Hammond ..... A45C 7/009 190/108
2010/0252592 A1 * 10/2010 McKinney ..... A45F 5/06 224/255
2011/0101052 A1 * 5/2011 Armstrong ..... A45F 3/14 224/254
2011/0204107 A1 * 8/2011 LeMert ..... A45F 3/14 224/250

* cited by examiner

SYSTEM FOR TRANSPORTING RECREATIONAL AND SPECIALIZED FOOTWEAR

BACKGROUND

Field of the Invention

The present invention is directed to carriers for footwear and, in particular, to a system for transporting recreational and specialized footwear using a sleek and flexible apparatus capable of retaining its shape.

Related Art

Many sports and recreational activities require the use of specialized footwear. By way of example only, specialized footwear is available for the following activities: cross-fit, hiking, cycling, rock climbing, mountain biking, soccer, basketball, baseball, boxing, wrestling, tennis, running and training.

In the majority of instances it is not feasible to wear specialized footwear throughout the day, therefore individuals who wish to travel with a pair of specialized footwear while commuting tend to look for convenient ways to carry them. Typically an extra pair of footwear is carried in an additional bag or in an existing backpack or other item of luggage. Alternatively the laces are tied to an existing backpack or thrown over the individual's shoulder. These current methods have several disadvantages, for example carrying the footwear in your bag, backpack or luggage takes up a lot of space which may be needed for a laptop, books or other items. Additionally, it may not be desirable to place dirty or wet footwear in a bag with other items. It may be desirable to have wet or dirty footwear exposed to the air after removal rather than trapping moisture and smell by placing them in an enclosed bag. Another disadvantage is that carrying an extra bag to hold the footwear or carrying the footwear in hand or on person can be cumbersome. Tying the laces onto an existing bag allows the footwear to swing while walking or biking which is not only uncomfortable for the carrier but also exposes the footwear to damage. There are existing footwear carriers that attempt to solve some of these problems for example U.S. application Ser. No. 12/588,872 recognizes the need for a system that allows the transport of footwear by attaching to an existing bag or other item of luggage, however the disclosed device is an enclosed system for transporting footwear thereby trapping moisture and scent during transport. U.S. application Ser. No. 10/792,227 recognizes the need for a footwear carrier which allows the shoes to breathe during transport, however the disclosed device requires the user to bore a hole into the heel of each shoe in order to use the device. Additionally, the device allows swinging of the footwear during transport thereby exposing the footwear to damage. There is a need for a system for carrying recreational and specialized footwear which is easily transportable with minimal swinging and allows the footwear to breathe during transport.

SUMMARY OF THE INVENTION

It is to be understood that the phraseology and terminology employed herein are for the purpose of the description and should not be regarded as limiting.

The present invention is directed to a system for transporting an extra pair of footwear such as recreational or specialized footwear used during sports and indoor and outdoor recreational activities, comprising a flexible footwear carrier and a bag. For the purposes of this invention a bag may include a gym bag, backpack, messenger bag, duffle bag, suitcase or other similar carrying item. The footwear carrier comprising a handle for either holding the carrier or connecting the carrier to the bag, a left body for holding a left shoe, a right body for holding a right shoe, a left pivot point in between the left body and the left side of the handle allowing the left body to be rotated 360 degrees, a right pivot point in between the right body and the right side of the handle allowing the right body to be rotated 360 degrees and a connector comprising of two or more corresponding parts for securing the left body to the right body thereby reducing swinging of the footwear. These and other features of the present invention will become readily apparent upon further review of the specification and drawings.

BRIEF DESCRIPTION OF THE DRAWINGS

Embodiments of the present invention will be described by way of example only, and not limitation, with reference to the accompanying drawings in which.

DETAILED DESCRIPTION

Figure 1:
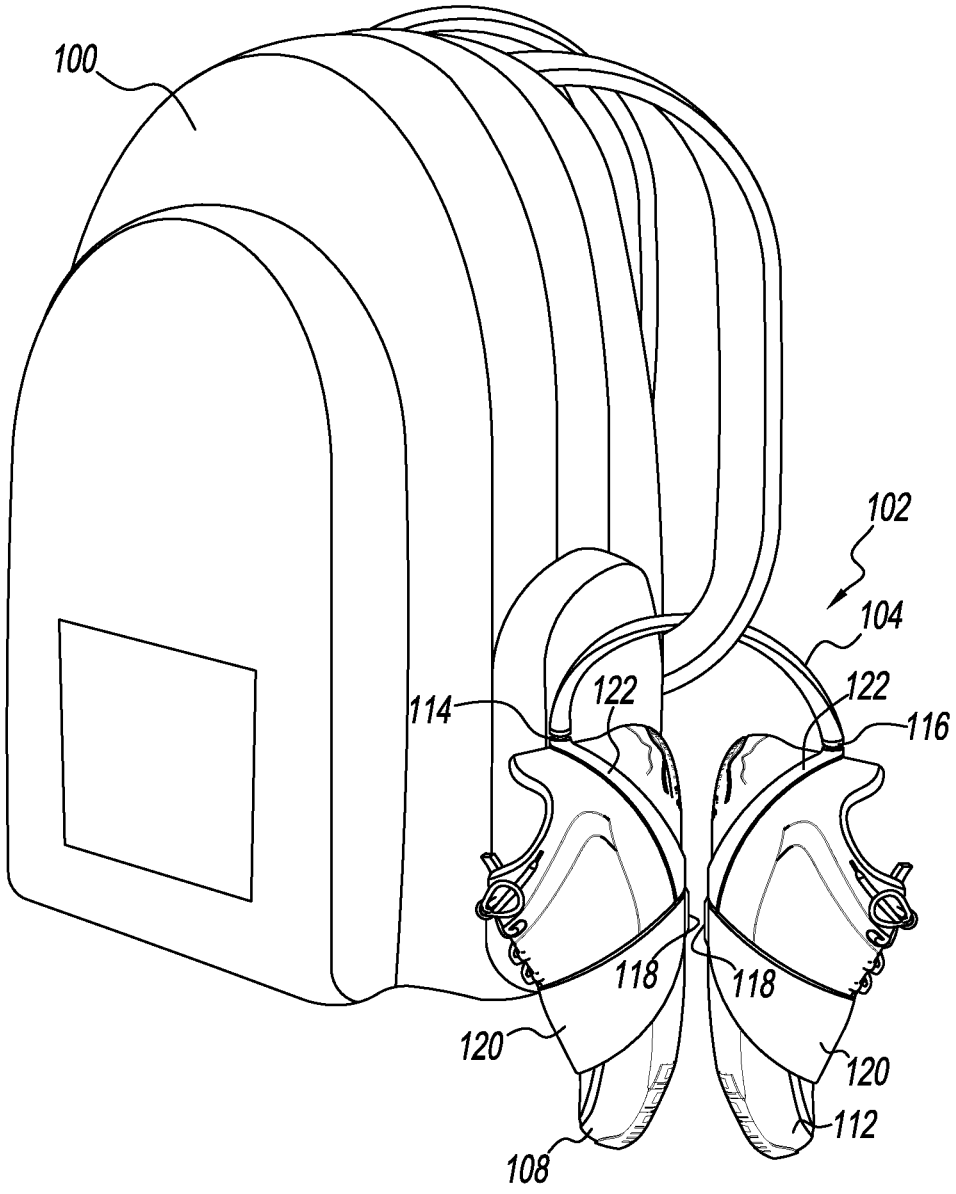
FIG. 1 is a perspective view of a system for transporting recreational and specialized footwear according to the present invention.
Figure 2:
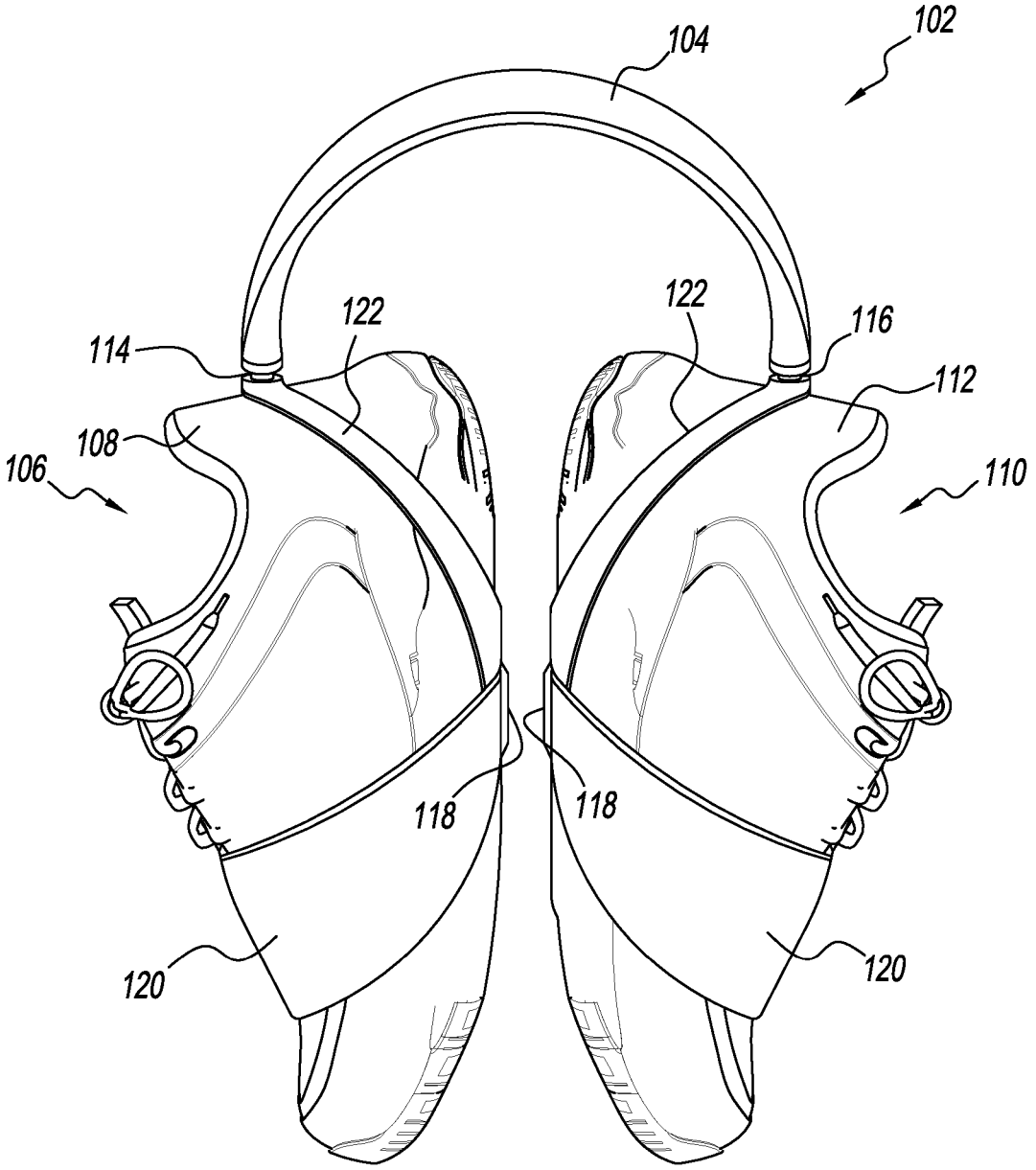
FIG. 2 is a front perspective view of a footwear carrier with a pair of shoes inserted and rotated sufficiently to engage the corresponding parts of the connector where the corresponding parts of the connector are at the bottom of each shoe according to one embodiment of the present invention.

Referring now to the figures, where similar reference characters denote similar elements throughout the figures, FIG. 1 shows a perspective view of a system for transporting an extra pair of footwear according to the present invention comprising a sleek, lightweight and flexible footwear carrier 102 and a bag 100. FIG. 2 depicts a preferred embodiment of the footwear carrier 102 with a pair of shoes inserted, comprising a handle 104 for either holding the footwear carrier 102 or connecting the footwear carrier 102 to the bag 100, a left body 110 for holding a left shoe 112, a right body 106 for holding a right shoe 108, a left pivot point 116 in between the left body 110 and the left side of the handle 104 allowing the left body 110 to be rotated 360 degrees, a right pivot point 114 in between the right body 106 and the right side of the handle 104 allowing the right body 106 to be rotated 360 degrees, and a connector 118 comprising of two or more corresponding parts for securing the left body 110 to the right body 106 thereby reducing swinging of the footwear carrier 102.

The footwear carrier 102 is primarily made of an elastic fabric or an elastic fabric blend such as neoprene, rubber, polyester neoprene blend, elastane fabric blend or some similar fabric blend typically known in the art to be flexible enough to allow folding while preventing creasing and shape loss. Different sections of the footwear carrier 102 may be made of different materials and fabrics some of which may include leather, mesh, nylon and cotton. The material used to form the dorsal section 120 should preferably be sufficiently thick such that the laces of the shoe are not imprinted into the material. The pivot points shown at 116 and 114 provide 360 degree rotation of the left body 110 and right body 106. The pivot points 116 and 114 may be made of a fabric or material that is easily twisted or they may take the form of a small device such as a pivot hinge or ball bearing or another device generally known in the art to allow 360 degree rotation. The connector 118 comprises of two or more corresponding parts which may include, but are not limited to magnets, male and female connectors and fasteners, hook and eye fasteners, and hook and loop fasteners. The handle 104 may vary in length but is preferably sufficiently short such that the footwear carrier is secured snuggly on a bag when the left body 110 and right body 106 are connected. The handle may be rigid or flexible, and flat, cylindrical or tubular.

Figure 3:
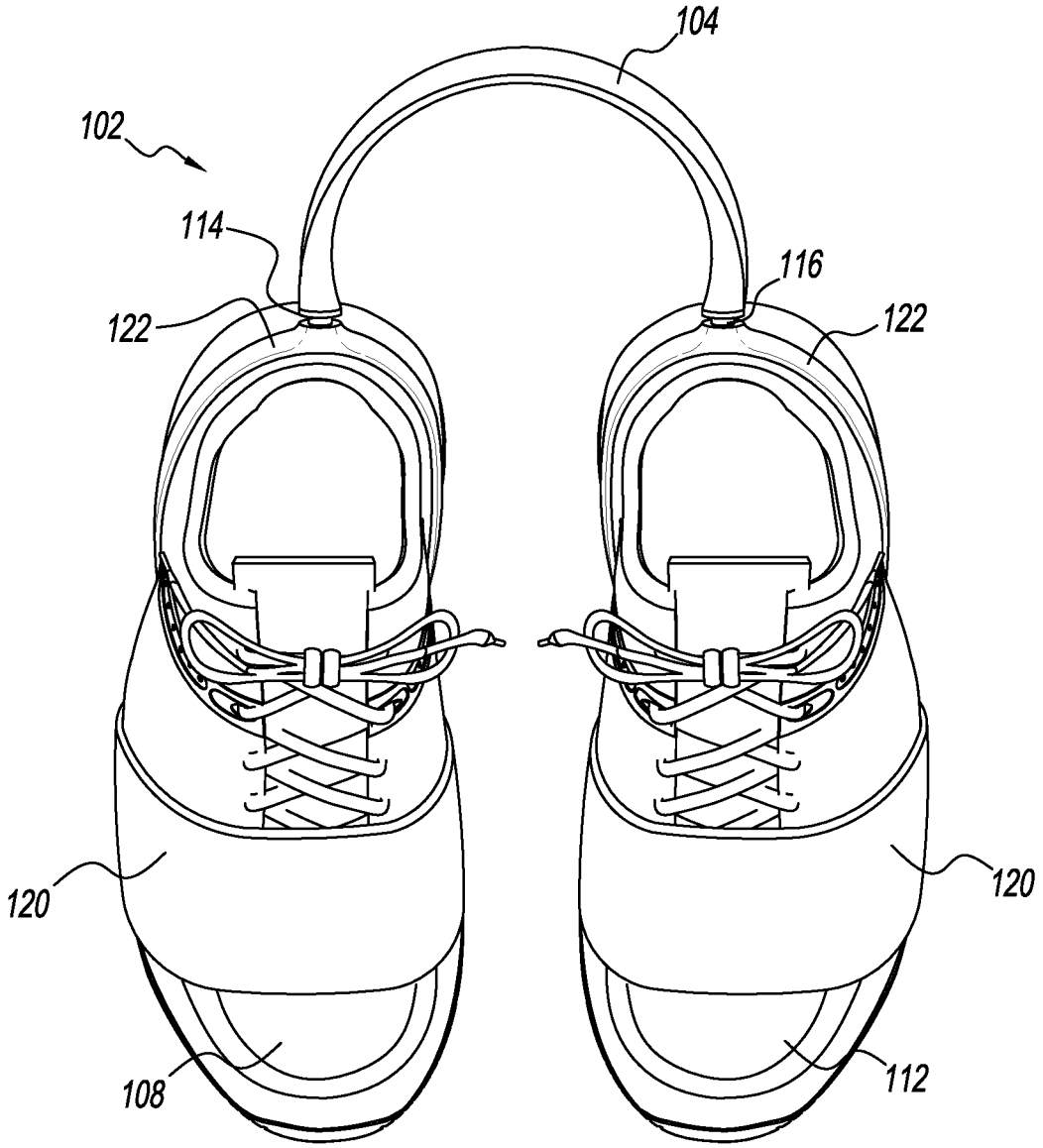
FIG. 3 is a front perspective view of a footwear carrier with a pair of shoes inserted according to one embodiment of the present invention.
Figure 4:
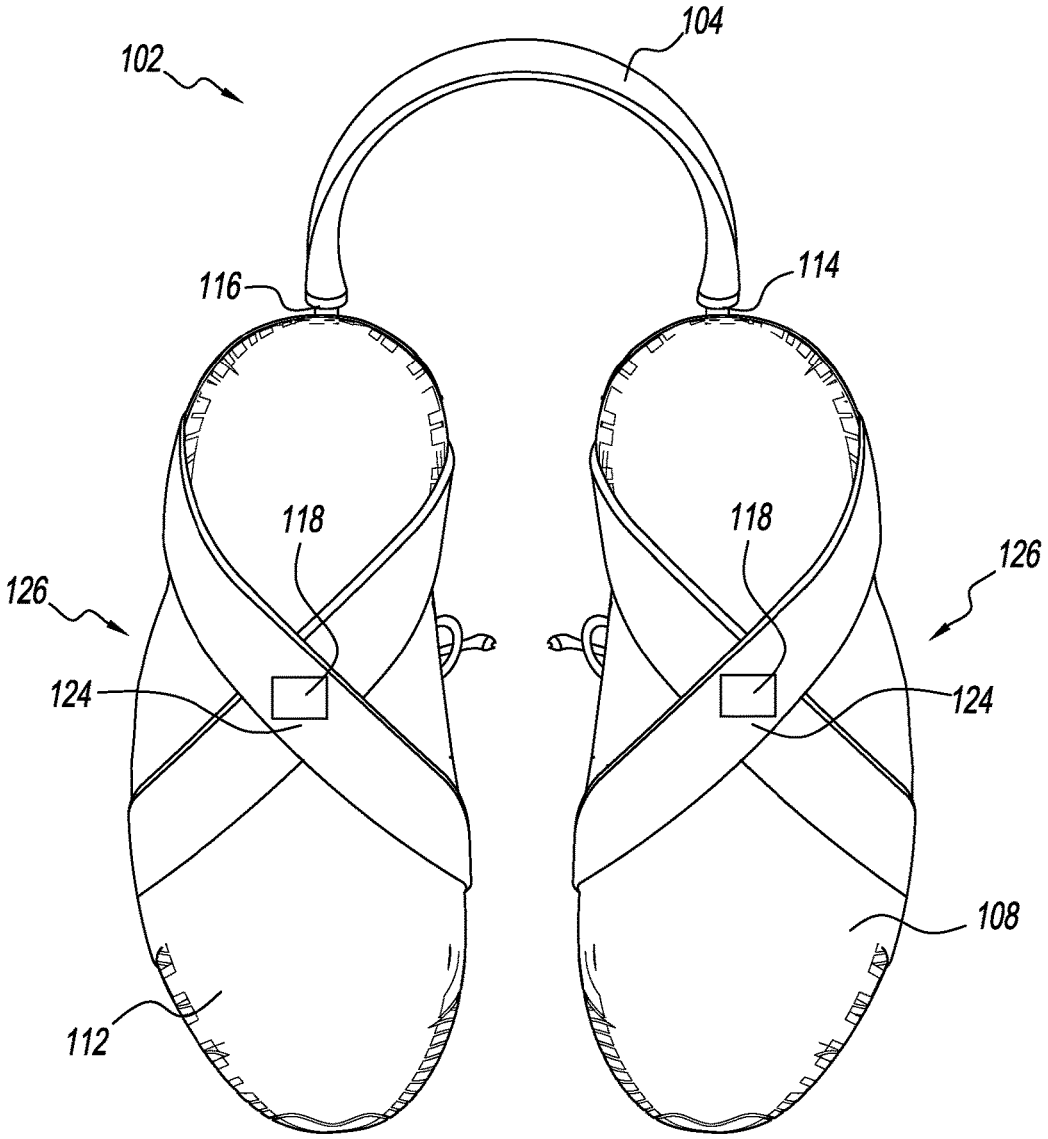
FIG. 4 is a rear perspective view of a footwear carrier with a pair of shoes inserted according to one embodiment of the present invention.
Figure 5:
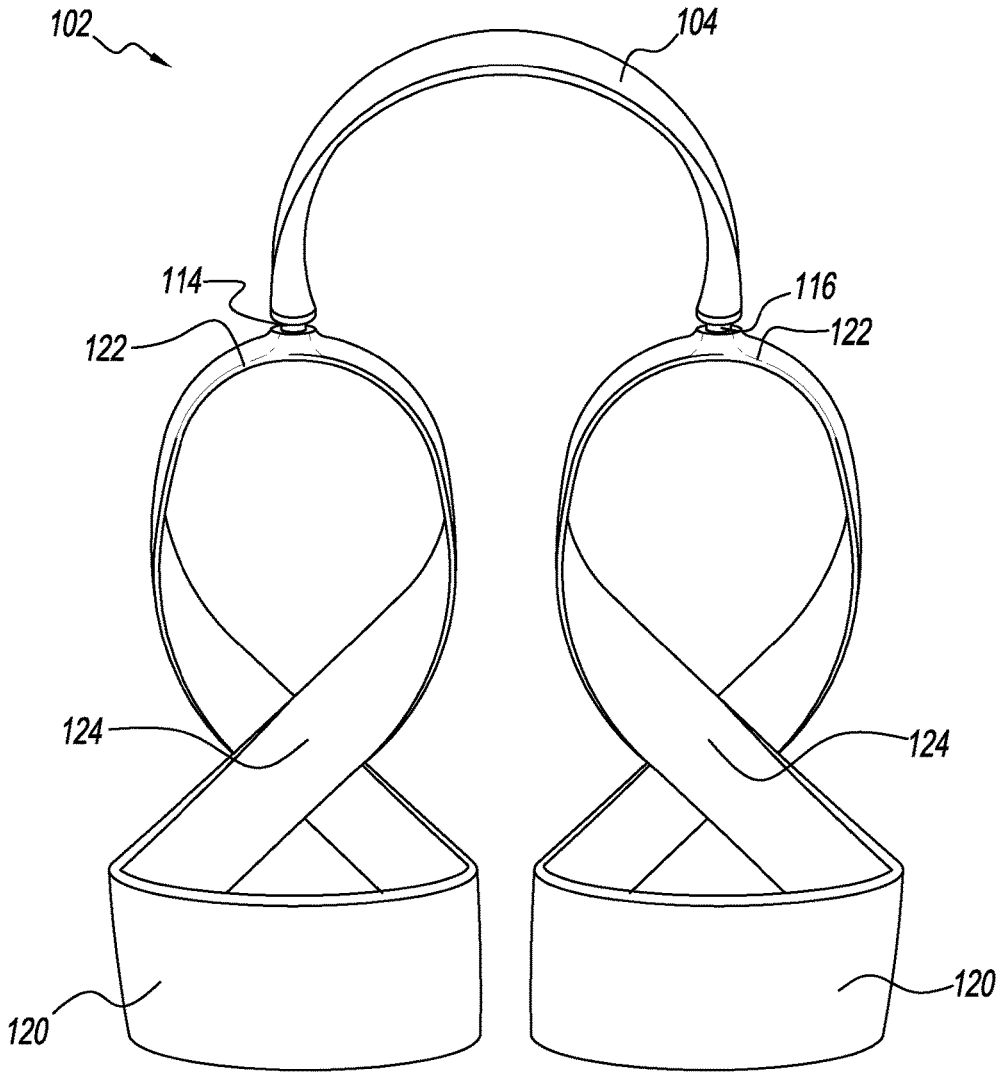
FIG. 5 is a front perspective view of a footwear carrier according to one embodiment of the present invention.
Figure 6:
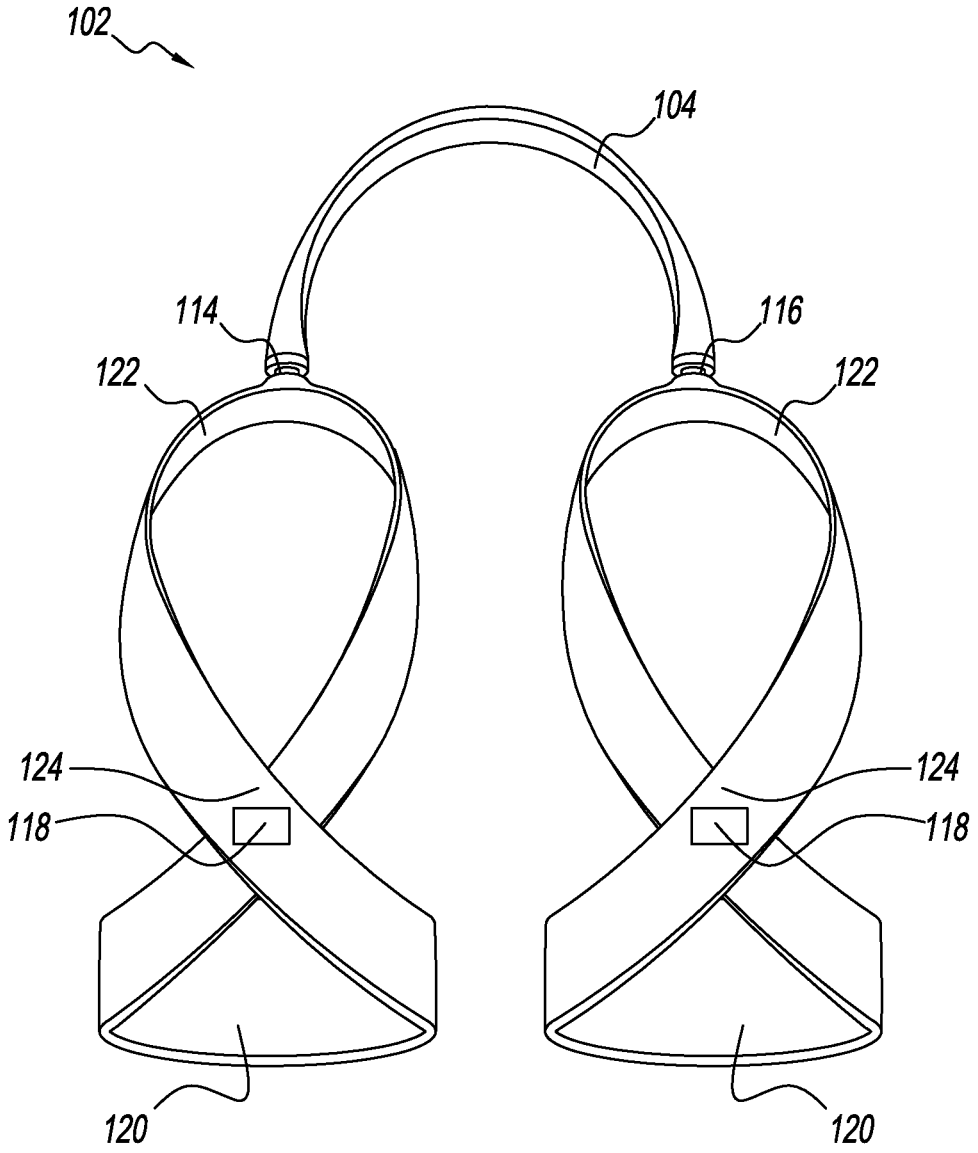
FIG. 6 is a rear perspective view of a footwear carrier according to one embodiment of the present invention.

FIGS. 5 and 6 show front and rear perspective views respectively of a preferred embodiment of the footwear carrier 102. FIGS. 3 and 4 show the footwear carrier 102 after a pair of shoes are inserted. The toe of the left shoe 112 is inserted into the dorsal section 120 of the left body 110 and the heel section 122 of the left body is looped around the heel of the left shoe 112. The toe of the right shoe 108 is inserted into the dorsal section 120 of the right body 106 and the heel section 122 of the right body 106 is looped around the heel of the right shoe 108. As shown in FIG. 1 the handle 104 is placed over the strap of the bag 100 such that the shoes are hanging from the strap of the bag 100. The pivot points 114 and 116, as magnified in FIGS. 9 and 10 allow the left body 110 and the right body 106 to be rotated sufficiently such that the corresponding parts of the connector 118 are aligned to be engaged and are thereafter engaged.

Figure 7A:
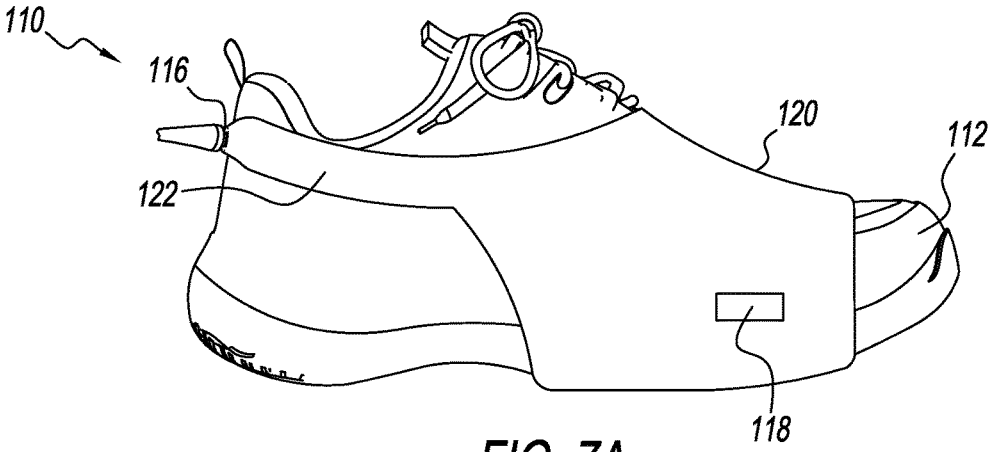
FIG. 7*a* is a side view of the left body of a footwear carrier with a left shoe inserted according to an embodiment of the present invention.
Figure 8:
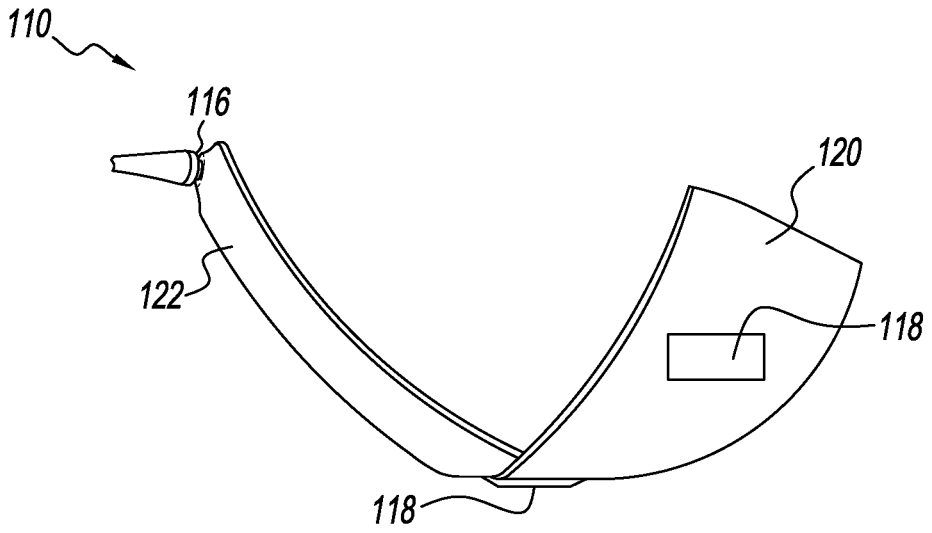
FIG. 8 is a side view of the left body of a footwear carrier with both a bottom and side connector according to an embodiment of the present invention.

As shown in FIGS. 2 and 6, the corresponding parts of the connector 118 may be located on the basal section 126 of the footwear carrier allowing the left body 110 and the right body 106 to be secured when rotated sufficiently such that the bottoms of the left body 110 and the right body 106 are facing one another. Alternatively, as shown in FIG. 7*a* the corresponding parts of the connector 118 may be located on the inner sides of the left body 110 and the right body 106 of the footwear carrier 102 allowing the left body 110 and the right body 106 to be secured adjacently. FIG. 8 shows an embodiment of the footwear carrier where the corresponding parts of the connector 118 are located on the inner sides of the left body 110 and the right body 106 of the footwear carrier 102 and on the basal section 126 of the footwear carrier allowing the left body 110 and the right body 106 to be secured adjacently or bottom to bottom.

Figure 7B:
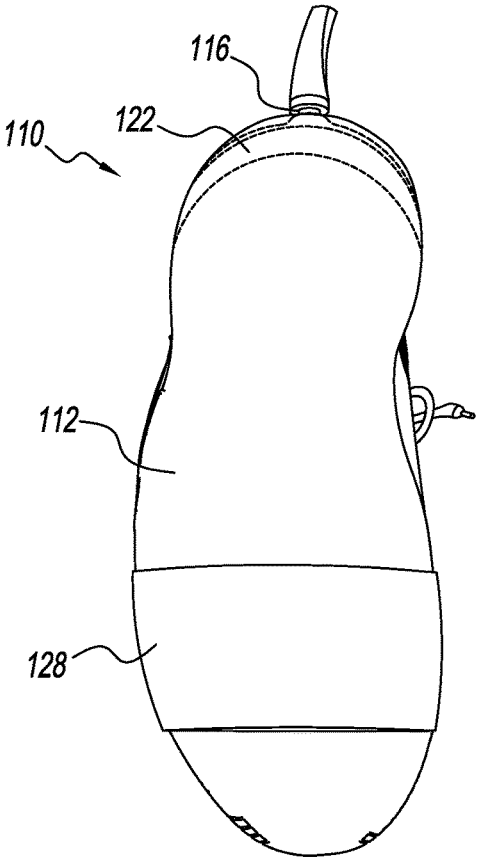
FIG. 7*b* is a rear perspective view of a left body of a footwear carrier with a left shoe inserted according to an embodiment of the present invention.

Referring now to FIGS. 7*a* and 7*b*, which show another embodiment of the present invention, the dorsal section 120 of the footwear carrier 102 loops around the front of the shoe, the heel section 122 connects to the dorsal section 120 on each side and loops around the heel of the shoe. In this embodiment of the present invention the basal section 126 is a mirror of the dorsal section 120. In a preferred embodiment of the present invention according to FIGS. 4, 5 and 6 the basal section 126 of the footwear carrier 102 forms a cross 124. When the shoes are inserted into the footwear carrier 102 the cross 124 of the basal section 126 rests on the arches of the shoe.

Figure 9:
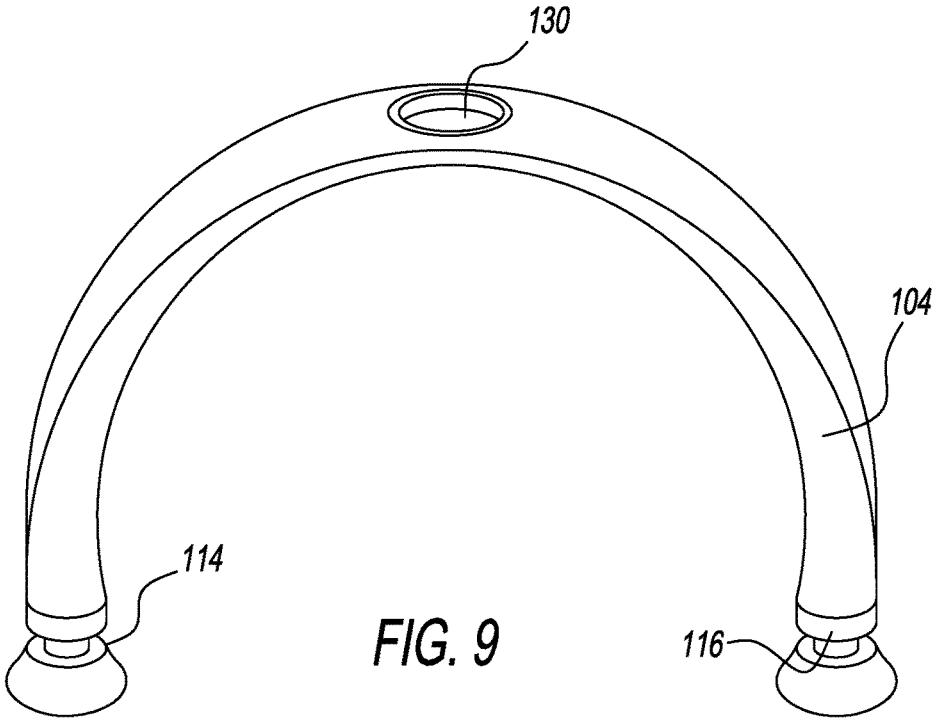
FIG. 9 is a front perspective view of a handle of a footwear carrier according to an embodiment of the present invention.
Figure 10:
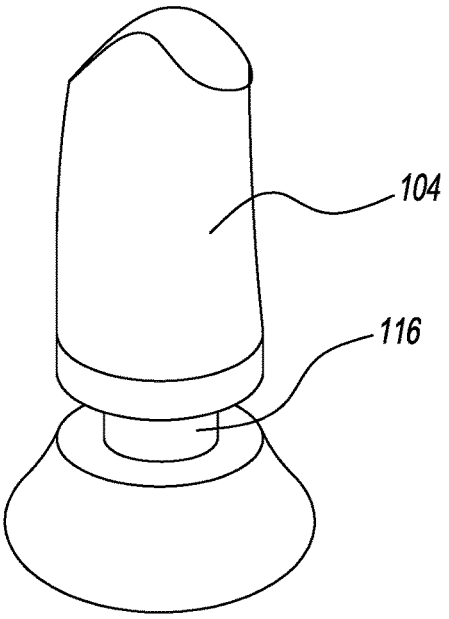
FIG. 10 is a front perspective view of a pivot point of a footwear carrier according to one embodiment of the present invention.

In one embodiment of the present invention as shown in FIG. 9, the handle 104 of the footwear carrier 102 further comprises a secure connector for securing the footwear carrier to a bag 100. The secure connector may be attached to the handle via an eyelet 130 or another connection means generally known in the art. The secure connector may take the form of a clasp, a ring with an open and close function, a clip, a hook and loop fastener or other similar means. It is to be understood that the present invention is not limited to the embodiments described above, but encompasses any and all embodiments within the scope of the following claims.

What is claimed is:

1. A footwear carrier, comprising:

a handle;

a left body for holding a left shoe, the left body consisting essentially of a strap;

the strap of the left body being twisted to form a point of overlap at which a first surface of the strap crosses completely under and contacts a second surface of the strap;

a right body for holding a right shoe, the right body consisting essentially of a strap;

the strap of the right body being twisted to form a point of overlap at which a first surface of the strap crosses completely under and contacts a second surface of the strap;

a left pivot point in between the left body and the left side of the handle for allowing the left body to be rotated 360 degrees;

a right pivot point in between the right body to the right side of the handle for allowing the right body to be rotated 360 degrees; and a connector comprising of two or more corresponding parts located on the left body and the right body for securing the left body to the right body.

2. The footwear carrier of claim 1 wherein the handle further comprises a secure connector attached to the handle for securing the footwear carrier to a bag.

3. The footwear carrier of claim 1 wherein the handle is adjustable.

4. The footwear carrier of claim 1 wherein the corresponding parts of the connector are located on the bottom of the footwear carrier.

5. The footwear carrier of claim 1 wherein the corresponding parts of the connector are located on the inner sides of the left body and the right body of the footwear carrier.

6. The footwear carrier of claim 1 wherein the corresponding parts of the connector are located on the bottom of the footwear carrier and on the inner sides of the left body and the right body of the footwear carrier.

7. A system for transporting footwear, comprising:

a bag, comprising a receptacle and at least one strap; and a footwear carrier attached to at least one strap of the bag, comprising:

a handle;

a left body for holding a left shoe, the left body consisting essentially of a strap;

the strap of the left body being twisted to form a point of overlap at which a first surface of the strap crosses completely under and contacts a second surface of the strap;

a right body for holding a right shoe, the right body consisting essentially of a strap;

the strap of the right body being twisted to form a point of overlap at which a first surface of the strap crosses completely under and contacts a second surface of the strap;

a left pivot point in between the left body and the left side of the handle for allowing the left body to be rotated 360 degrees;

a right pivot point in between the right body to the right side of the handle for allowing the right body to be rotated 360 degrees; and a connector comprising of two or more corresponding parts located on the left body and the right body for securing the left body to the right body.

8. The footwear carrier of claim 1, wherein the strap of the left body and the strap of the right body are each in a figure eight arrangement.

* * * * *